US006468052B2

(12) United States Patent
McKain et al.

(10) Patent No.: US 6,468,052 B2
(45) **Date of Patent: *Oct. 22, 2002**

(54) VACUUM RELIEF DEVICE FOR FLUID TRANSFER AND CIRCULATION SYSTEMS

(75) Inventors: Paul C. McKain, 3300 NW. 97th Ave., Sunrise, FL (US) 33351; Mark Fritze, 558 Lakeside Cir., Sunrise, FL (US) 33326

(73) Assignees: Robert M. Downey, Boca Raton, FL (US); Paul C. McKain, Sunrise, FL (US); Mark Fritze, Sunrise, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/756,378

(22) Filed: Jan. 8, 2001

(65) Prior Publication Data

US 2001/0002238 A1 May 31, 2001

Related U.S. Application Data

(63) Continuation-in-part of application No. 09/357,036, filed on Jul. 20, 1999, now Pat. No. 6,171,073, which is a continuation-in-part of application No. 08/901,849, filed on Jul. 28, 1997, now Pat. No. 5,947,700.

(51) Int. Cl.[7] ..... F04B 49/00

(52) U.S. Cl. ..... 417/306; 417/18; 417/20; 417/279

(58) Field of Search ..... 417/18, 20, 279, 417/306

(56) References Cited

U.S. PATENT DOCUMENTS 4,115,878 A * 9/1978 Johnson et al. ..... 210/416.1
4,596,656 A * 6/1986 Higginbotham et al. .... 210/136
4,861,231 A * 8/1989 Howard ..... 200/81 H
5,076,761 A * 12/1991 Krohn et al. ..... 417/18
5,120,198 A * 6/1992 Clark ..... 340/606
5,347,664 A * 9/1994 Hamza et al. ..... 210/416.2
5,464,327 A * 11/1995 Horwitz ..... 417/12
5,499,406 A * 3/1996 Chalberg et al. ..... 4/504
5,570,481 A * 11/1996 Mathis et al. ..... 200/83 J
5,947,700 A * 9/1999 McKain et al. ..... 4/541.2
6,171,073 B1 * 1/2001 McKain et al. ..... 4/541.2

* cited by examiner

*Primary Examiner*—Charles G. Freay
*Assistant Examiner*—Timothy P. Solak
(74) *Attorney, Agent, or Firm*—Robert M. Downey P.A.

(57) ABSTRACT

A safety device for use in a fluid transfer and/or circulation system of the type which uses a pump to draw water from a reservoir through one or more intake lines each extending from an open end at the reservoir to the pump intake. The safety device connects to the fluid transfer/circulation system and includes a sensor, a triggering mechanism, and a vacuum breaker. When the pump is operating, the sensor monitors one or more conditions of the system. When one or more of the monitored conditions deviates outside of a normal operational range, as a result of an obstruction of any one or more of the open ends of the intake lines, the triggering mechanism triggers the vacuum breaker to eliminate negative pressure in the system by introducing air from atmosphere into the intake lines, thereby removing suction at the open ends of the intake lines. The safety device may further activate warning devices including audible and visible alarms to indicate that the system has been deactivated.

8 Claims, 8 Drawing Sheets

VACUUM RELIEF DEVICE FOR FLUID TRANSFER AND CIRCULATION SYSTEMS

This application is a continuation-in-part application based on patent application Ser. No. 09/357,036 filed on Jul. 20, 1999 now U.S. Pat. No. 6,171,073, which was a continuation-in-part application based on previously filed patent application Ser. No. 08/901,849 filed on Jul. 28, 1997, now U.S. Pat. No. 5,947,700 granted on Sep. 7, 1999.

BACKGROUND OF THE INVENTION

1. Field of the Invention

The present invention relates to a safety device for fluid transfer systems and, more particularly, to a safety device for eliminating vacuum pressure in the system in response to an obstruction of one or more open intake lines, thereby removing a suction force at the open ends of intake lines in the system.

2. Description of the Related Art

Drowning is the second leading cause of unintentional injury related deaths to children 14 years old and younger. Most drownings occur in swimming pools and hot tubs, and in many incidents (involving both adults and children) the main culprit is the water circulation system. In a typical pool, the circulation system includes a main drain suction intake line and at least one skimmer suction intake line, both of which feed into a main intake line that leads to a pump. A return line directs water flow back into the pool.

Most people do not feel threatened by a pool's circulation system, including the main drain intake on the bottom of the pool, and the skimmer boxes along the side of the pool. However, if a person comes into contact with any of the suction intake lines of the circulation system (at either the main drain or skimmer intakes) causing the suction intake to be covered or obstructed, the immense suction of the pump forms an instant seal between the open end of the suction intake line and the person's skin or clothing. This may result if a person places their hand over the open end of the suction intake line or, as often happens with children, a person sits down on the suction intake. In either case, the force needed to pull them free often exceeds 800 pounds. Moreover, the injuries which are inflicted in a matter of a few seconds are horrific, usually permanent and sometimes fatal. If a person, especially a child, is sucked onto the main drain suction intake on the bottom of the pool, they usually drown.

The only way to free a person sucked onto the intake of a circulation system of this type, without causing severe injury or dismemberment, is to eliminate the vacuum (i.e. negative pressure) in the intake between the entrapped person and the pump, to thereby remove the intense suction force at the open end of the intake line. It is helpful to disable the source of the suction by interrupting power to the pump. However, even if the pump is shut down, a vacuum can remain in the intake side of the system between the pump and the obstructed end of the suction intake line. Sometimes, a victim could still be freed with some assistance, although serious injury or death may result. Ideally, if the vacuum in the intake line can be quickly eliminated after a victim becomes stuck to the intake, the victim will be freed with little or no assistance and without injury.

In the most instances wherein a victim becomes stuck to an intake of a circulation system, typically in a swimming pool or hot tub, rescuers fail to realize the need to immediately shut off the pump. Instead, in a panic, people tend to go the victim and attempt prying them free. In the rare instance this is successful, the injuries are often severe and permanent. Of course, there are also instances wherein there are no other people present to come to the victim's rescue. These situations are almost always fatal.

The imminent danger presented by fluid circulation systems of the type commonly found in swimming pools, hot tubs, and the like has been longstanding in the art. Little, if any attention has been given to providing a satisfactory solution to this deadly problem that exists in every swimming pool, hot tub, as well as all other fluid circulation systems wherein a fluid is drawn from a reservoir through one or more suction intakes by a pump. Accordingly, there has been and there remains an urgent need to provide an effective means of preventing death and injury to those otherwise unfortunate victims who become unexpectedly attached (i.e., entrapped) by suction to the intake of a fluid circulation system.

SUMMARY OF THE INVENTION

The present invention is directed to a device for use in a fluid transfer. and/or circulation system of the type including at least one pump which draws water from a reservoir through one or more intake lines each extending from an open end at the reservoir to an intake of the pump. The primary purpose of the invention is to save lives and property by alleviating the intense vacuum that builds when one or more of the suction intake ports of a pump assisted fluid circulation system becomes obstructed. The safety device includes means for sensing one or more operating conditions in the fluid transfer/circulation system (e.g., negative pressure levels, positive pressure levels, water flow rate, pump voltage and/or amperage) and means for analyzing the sensed operating conditions. When the pump is operating, the safety device continually analyzes the operating conditions of the system. If the device detects a deviation of the operating conditions outside of a normal operational range, the vacuum pressure relief means are actuated in order to eliminate negative pressure in the system, thereby removing suction at the open ends of the intake lines. The device also disables the pump, shutting it off, upon detecting the abnormal operation condition(s). In the event there is an absence of fluid movement when the pump is operating (e.g., broken pipes, reservoir dry, etc.), the device triggers the vacuum pressure relief means and disables the pump, thereby preventing damage to the system. Warning devices, including audible and visible alarms, may be provided to indicate that operation of the fluid transfer system has been interrupted. This is especially useful to alert users to the possible occurrence of an obstruction of the intake lines by a person or object and the need to inspect and reset the device prior to reactivating the fluid transfer system. Other options can also be integrated with the device, including remote audible alarms, visual indicators, a remote panic switch, and the like.

OBJECTS AND ADVANTAGES OF THE INVENTION

With the foregoing in mind, it is a primary object of the present invention to provide a safety device for use in a fluid transfer/circulation system, wherein the device is structured to eliminate negative pressure in the system upon detecting a negative pressure level being outside of a selected operational range, thereby removing suction at the open ends of the intake lines.

It is a further object of the present invention to provide a safety device which is particularly useful in the fluid circulation systems of swimming pools, hot tubs and the like for preventing death and injury to persons or animals which become attached (i.e., entrapped) by suction to the intake openings of the system.

It is still a further object of the present invention to provide a safe, reliable and relatively inexpensive safety device for easy installation to existing fluid transfer/circulation systems and which automatically adjusts to any system, each time the fluid begins to flow, thereby establishing a normal operating range of conditions for each system, and wherein the device is structured to eliminate negative pressure in the system upon detecting an operating condition being outside (high or low) of the normal operating range, thereby removing suction at the open ends of the intake lines.

It is still a further object of the present invention to provide a reliable, relatively inexpensive safety device for use in a fluid transfer/circulation system of the type including at least one pump which draws water from a reservoir through one or more intake lines, and wherein the device is structured to deactivate the pump(s) and to further eliminate negative pressure in the system upon detecting one or more operating conditions of the system being outside of a predetermined range.

It is still a further object of the present invention to provide a safety device, as described above, further including warning devices such as, but not limited to, audible and visible alarms, to indicate that the safety device has been triggered to eliminate negative pressure in the intake lines of a fluid transfer system.

It is still a further object of the present invention to provide a safety device, as described above, which is contained in a totally sealed, compact unit for convenient, easy installation in-line with any fluid transfer/circulation system.

These and other objects and advantages of the present invention are more readily apparent with reference to the following detailed description taken in conjunction with the accompanying drawings.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENTS

Figure 1:
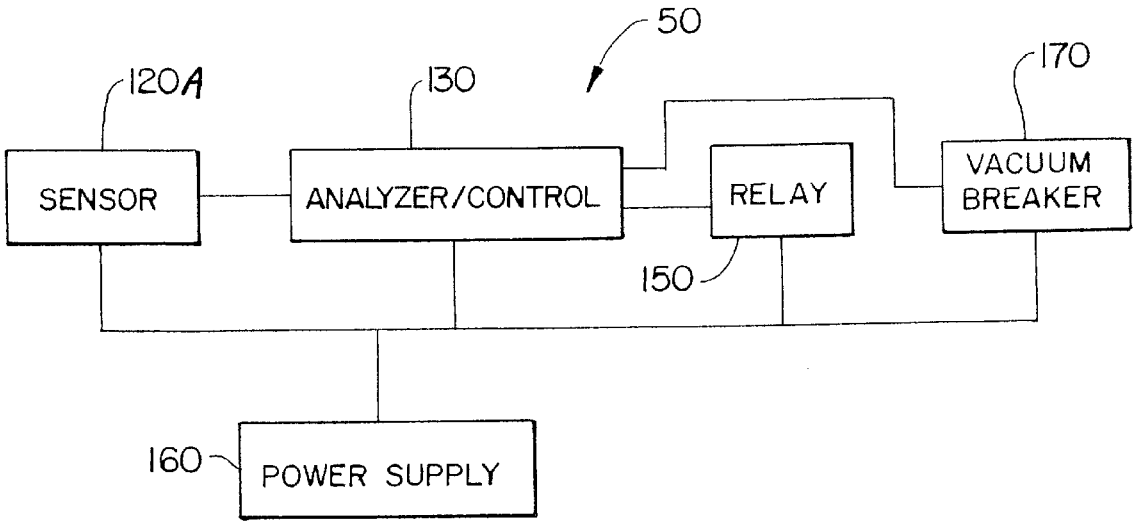
FIG. 1 is a schematic block diagram of the primary components of the safety device in accordance with a first preferred embodiment of the present invention.

The present invention is directed to a fluid vacuum safety device for use in a pump assisted fluid circulation system for the purposes of alleviating an intense vacuum that builds in the system when one or more of the suction intake ports of the circulation system become obstructed.

Referring to FIGS. 2, 4–6 and 8, a typical fluid circulation system of the type commonly found in swimming pools and hot tubs is shown. A reservoir of water W is contained within a structure having side walls 2 and a bottom 4. A main drain 6 having a drain cover grating is provided on the bottom 4. At least one skimmer box 8 is provided along one or more of the side walls 2 at the water surface level SL. A drain suction intake line 10 leads from the main drain 6 to a main suction intake line 20. A skimmer suction intake line 12 has an open end 13 is the skimmer box 8 which is maintained below the water surface level SL. The skimmer suction intake line 12 feeds into the main intake line 20. The main intake line 20 is directed to a pump 24 which may have a screen trap 26 connected to the main intake line 20, just prior to the intake of the pump 24. A main output line 28 leads to a filter 30. One or more return lines 32 extend from the filter 30 back to the water reservoir W to return water that is circulation through the system back to the reservoir W.

Figure 2:
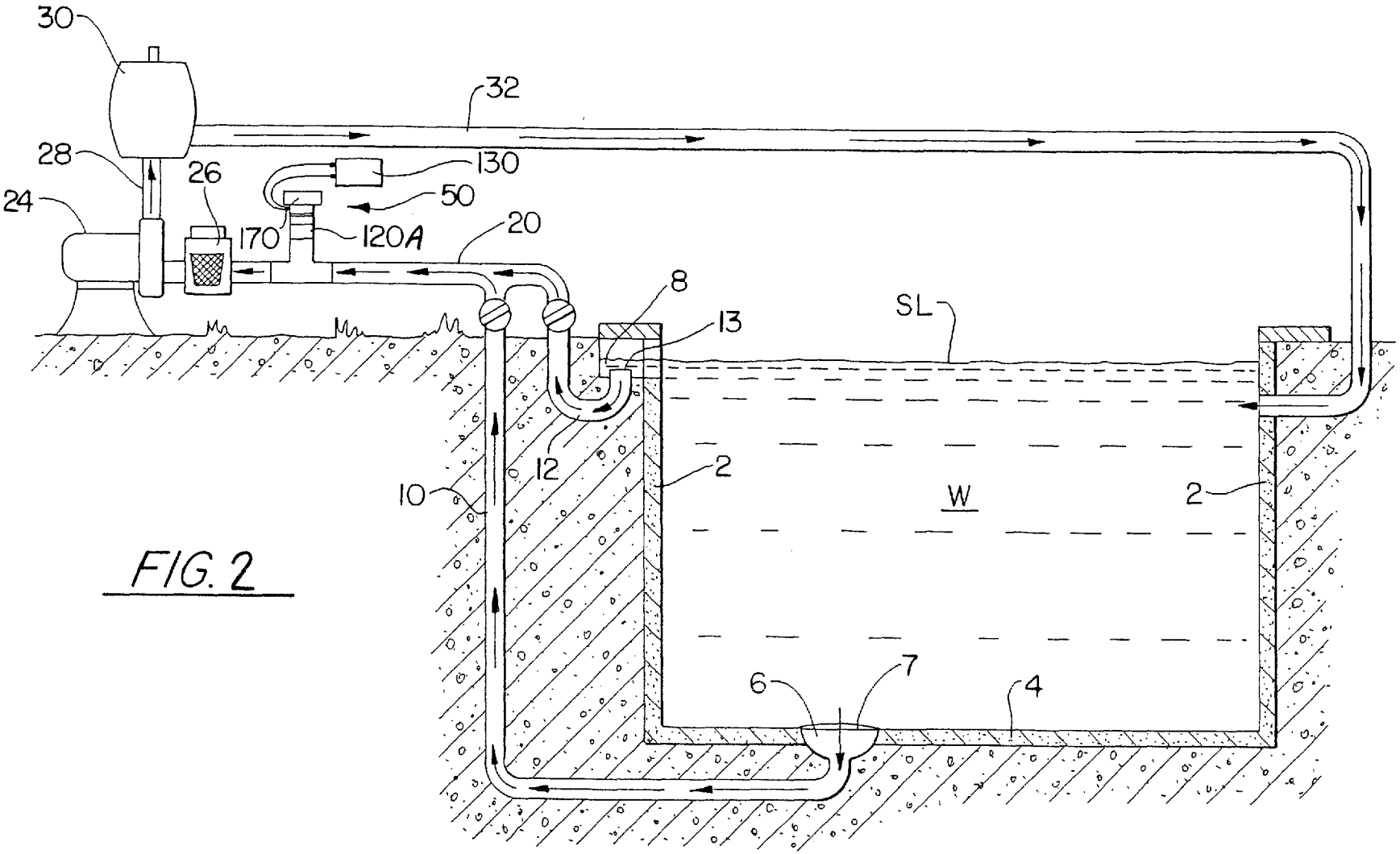
FIG. 2 is an elevational view, in partial section, illustrating a typical fluid circulation system for circulating fluid in a reservoir, such as a swimming pool, hot tub or the like, showing the safety device of the embodiment of FIG. 1 installed in-line on a main suction intake line of the system, between the intake of the system's pump and suction intake openings in the swimming pool.

FIG. 2 shows the fluid vacuum safety device 50 in accordance with one embodiment thereof installed in-line along the main suction intake line 20 of the circulation system, prior to the intake of the pump 24 and screen trap 26. If an object or person is caused to be sucked onto one of the open ends of the suction intakes, such as the open end 13 of the simmer suction intake 12, the drain plate 7 or, if the drain plate is removed, the drain suction intake line 10 at the main drain 6, a vacuum will instantly develop throughout the intake lines, including the main suction intake line 20. The fluid vacuum safety device 50 is designed to react to this situation to immediately eliminate the vacuum in the system and, accordingly, the suction force at the open ends of each of the suction intake lines, including the skimmer suction intake 13 and the main drain intake 6. Upon reaching a predetermined vacuum level, which happens quite rapidly when one of the intakes becomes obstructed, the fluid vacuum safety device 50 causes air from atmosphere to be rapidly introduced into the main intake line 20 and throughout the other intake lines, thereby removing all suction force at the open suction intake ends 13 and 6 in the reservoir W. The air introduced into the system interrupts the prime of the pump 24, thereby eliminating any further source of suction.

Referring now to FIG. 1, the principal components of the fluid vacuum safety device 50 are shown in block diagram form. Specifically, the principal components of the fluid vacuum safety device 50 include a sensor circuit 120A which senses the vacuum pressure level in the fluid circulation system. The output of the sensor circuit 120A is applied to an analyzer/control circuit 130 that allows selective setting (programming) of a particular negative pressure range (a predetermined high and low vacuum pressure level) which thereby defines a trip point (high or low) or emergency condition in the system. The output of the analyzer/control circuit 130 controls operational relays or contactors 150 to interrupt power to the pump 24 and triggers a vacuum breaker 170 upon detecting the trip point. In the preferred embodiment, the analyzer/control 130 is a programmable microprocessor and vacuum breaker 170 is a solenoid controlled valve. A power supply 160 furnishes voltage for the circuitry. The sensor 120A utilizes a strain gauge to sense the vacuum in the pump return line 20. The sensor 120A converts vacuum pressure to voltage readings. Changes in voltage readings correspond directly to vacuum pressure level changes in the system. The voltage readings are amplified in the sensor and sent to the analyzer/control 130 for processing.

Figure 3:
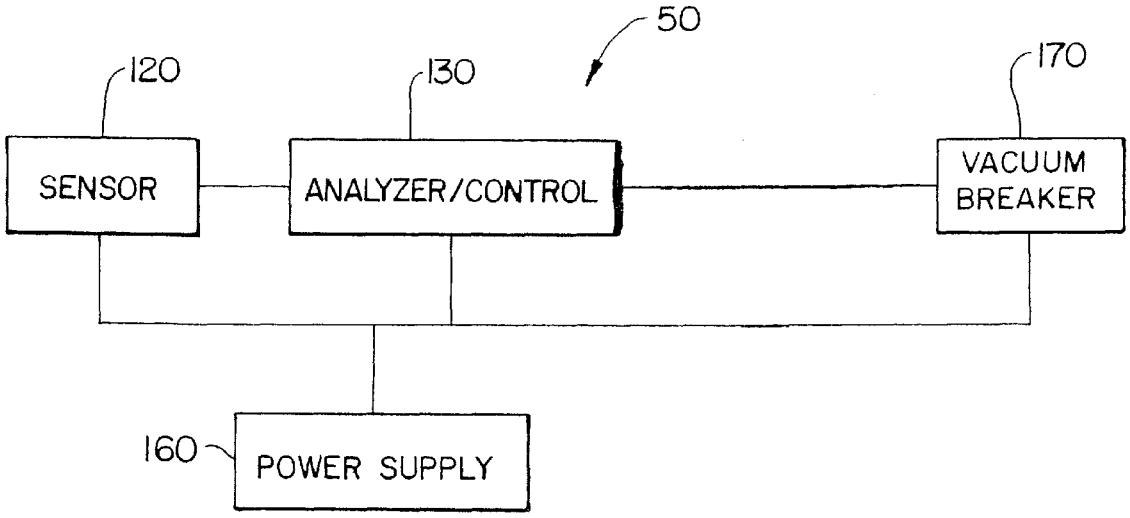
FIG. 3 is a schematic block diagram of the primary components of the safety device in accordance with several other preferred embodiments of the present invention, wherein the sensor may be a positive pressure sensor, a negative pressure (i.e., vacuum pressure) sensor, a fluid flow meter, a voltage meter, or an amperage meter.

Referring to FIG. 3, the principal components of the fluid vacuum safety device are shown in block diagram form in accordance with several additional embodiments thereof. Specifically, the sensor 120 shown in FIG. 3, may include any of a number of different sensors for measuring operating conditions in the swimming pool. In addition to the negative pressure sensor for sensing vacuum pressure level in the fluid circulation system, as described in connection with FIGS. 1 and 2, the sensor 120 may include a positive pressure sensor, a fluid flow meter, a voltage meter/regulator, and/or an amperage meter. The sensor 120, in accordance with the various embodiments represented by FIG. 3, communicates with the analyzer/control circuit 130 that allows selective setting "programming" of one or more particular operating conditions (e.g., vacuum pressure, positive pressure, water flow rate, pump voltage level and/or pump amperage level) which thereby defines a trip point (high or low) or emergency condition in the system. In several of the embodiments, the analyzer/control 130 is a programmable microprocessor and the vacuum breaker 170 is a solenoid controlled valve. When the analyzer/control 130 determines that the sensed one or more operating conditions, as sensed by the sensor 120, have deviated outside of a normal operational range (i.e., beyond the trip point), the analyzer/control 130 triggers actuation of the vacuum breaker 170 to introduce air from atmosphere into the intake line 20 of the fluid circulation system, thereby eliminating vacuum in the intake lines and further eliminating suction at the open intake ends 6, 13 within the reservoir W.

Figure 4:
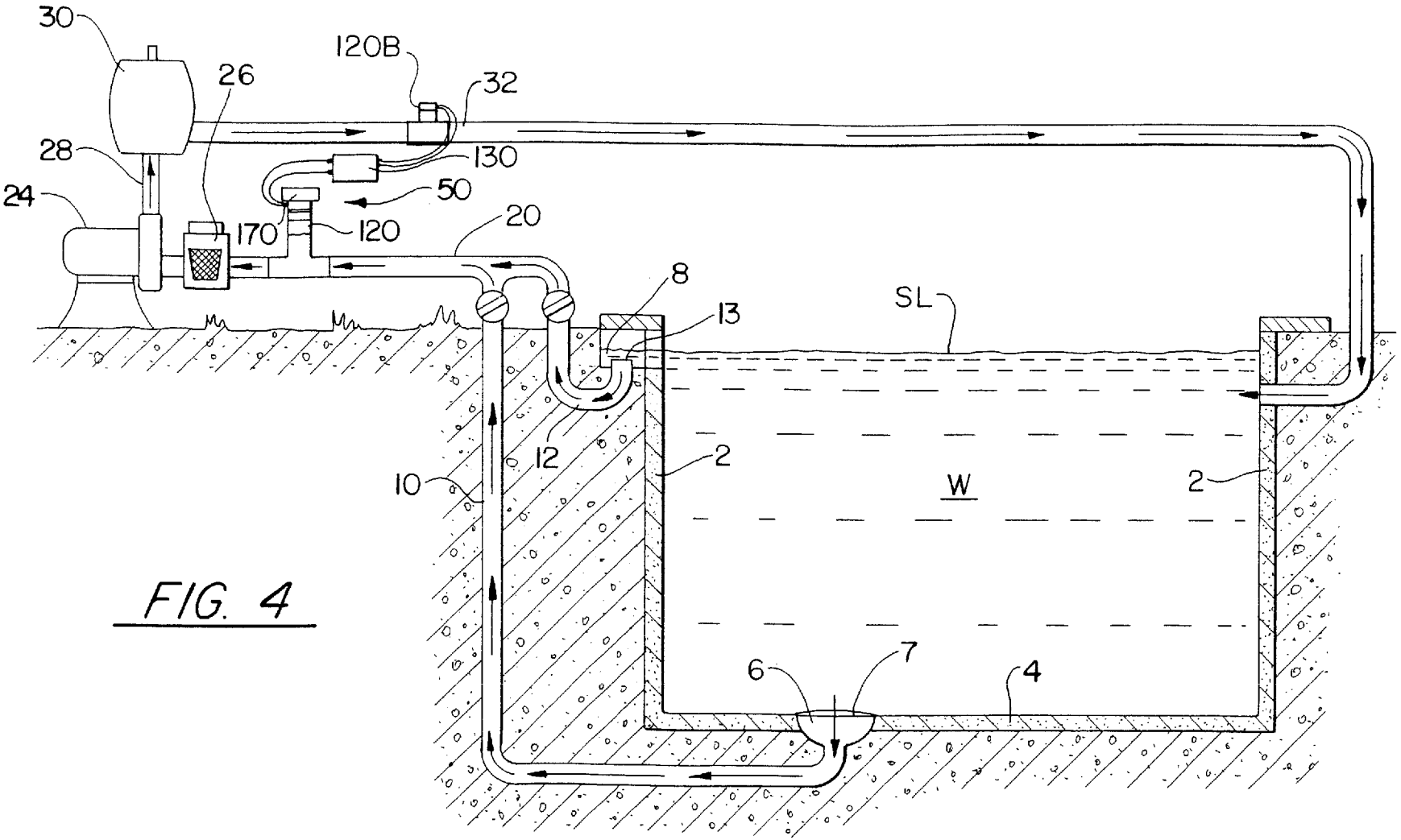
FIG. 4 is an elevational view, in partial section, similar to the view of FIG. 2, wherein the safety device includes a positive pressure sensor installed in-line with the return line of the fluid circulation system, on an output side of the pump, in accordance with another embodiment of the invention.

Referring to FIG. 4, the safety device 50 is shown installed in accordance with one preferred embodiment, wherein the safety device 50 includes a positive pressure sensor 120B installed in-line along the return line 32, between the output side of the pump 24 and the reservoir W. In this particular embodiment, the positive pressure sensor 120B is structured to measure the positive pressure in the return line 32 when the pump 24 is operating. A normal operational positive pressure range is established and is maintained in memory in the analyzer/control 130. In the event the positive pressure measured in the return line 32 deviates outside of a normal operational range, the analyzer/control 130 triggers the vacuum breaker 170 to introduce air into the main intake line 20. The analyzer/control 130 is also structured to interrupt power to the pump 24 to thereby terminate operation of the pump 24.

Figure 5:
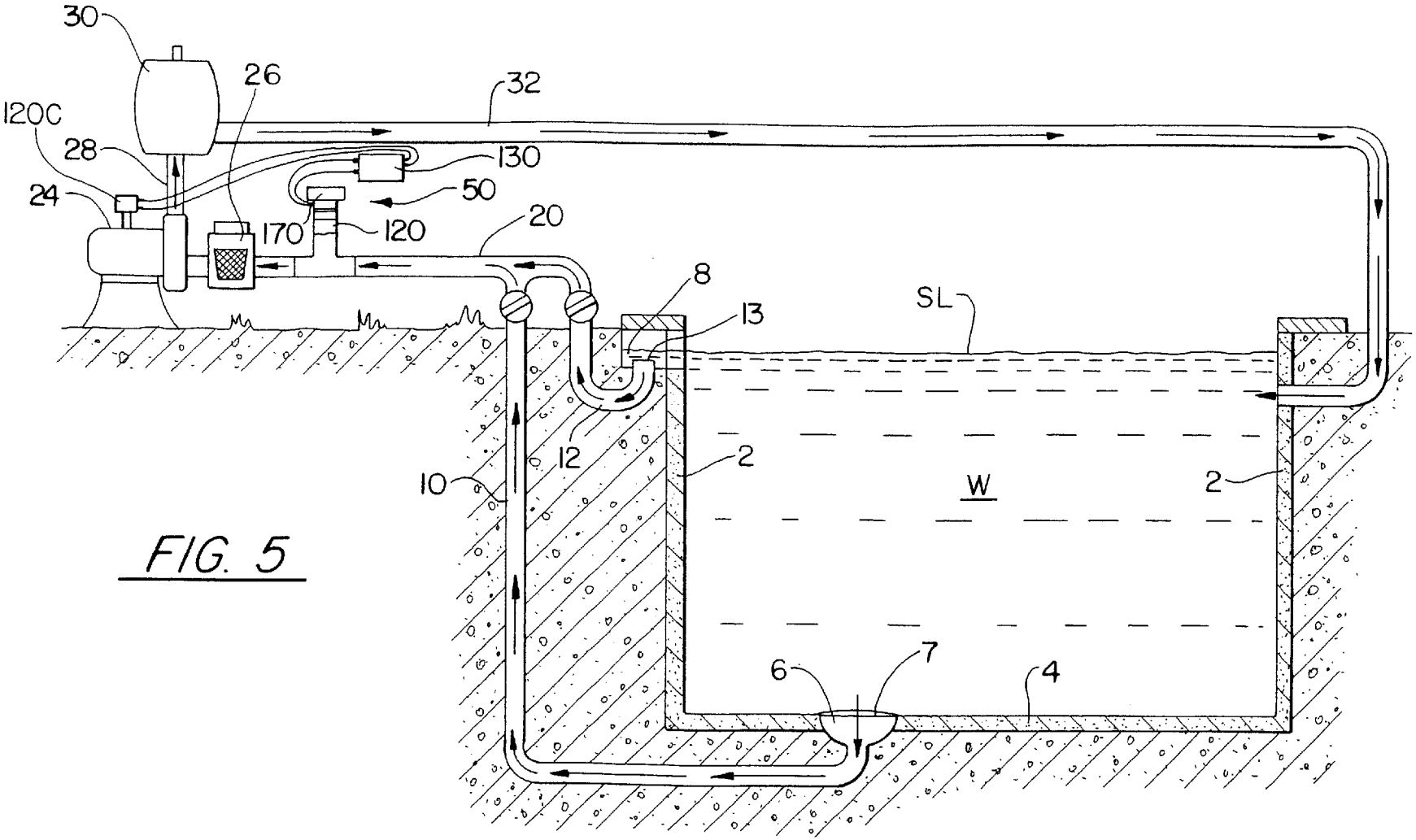
FIG. 5 is an elevational view, in partial section, similar to the views of FIGS. 2 and 4, wherein the safety device of the present invention is shown in accordance with yet another embodiment thereof, wherein a sensor is connected to the pump for measuring the voltage and/or the amperage drawn by the pump during operation thereof.

Referring to FIG. 5, the safety device 50 is shown in yet another embodiment of the invention, wherein the sensor 120C is adapted to read voltage and/or amperage levels of the pump during operation thereof. A normal voltage and/or amperage operating range for the pump is determined and is stored in the microprocessor memory of the analyzer/control 130. Should the voltage and/or amperage level drawn by the pump 24 deviate outside of the normal operational range, the analyzer/control 130 will trigger actuation of the vacuum breaker 170 to introduce air from atmosphere into the return line 20, thereby relieving suction at the open intakes 13 and 6 within the reservoir W.

Figure 6:
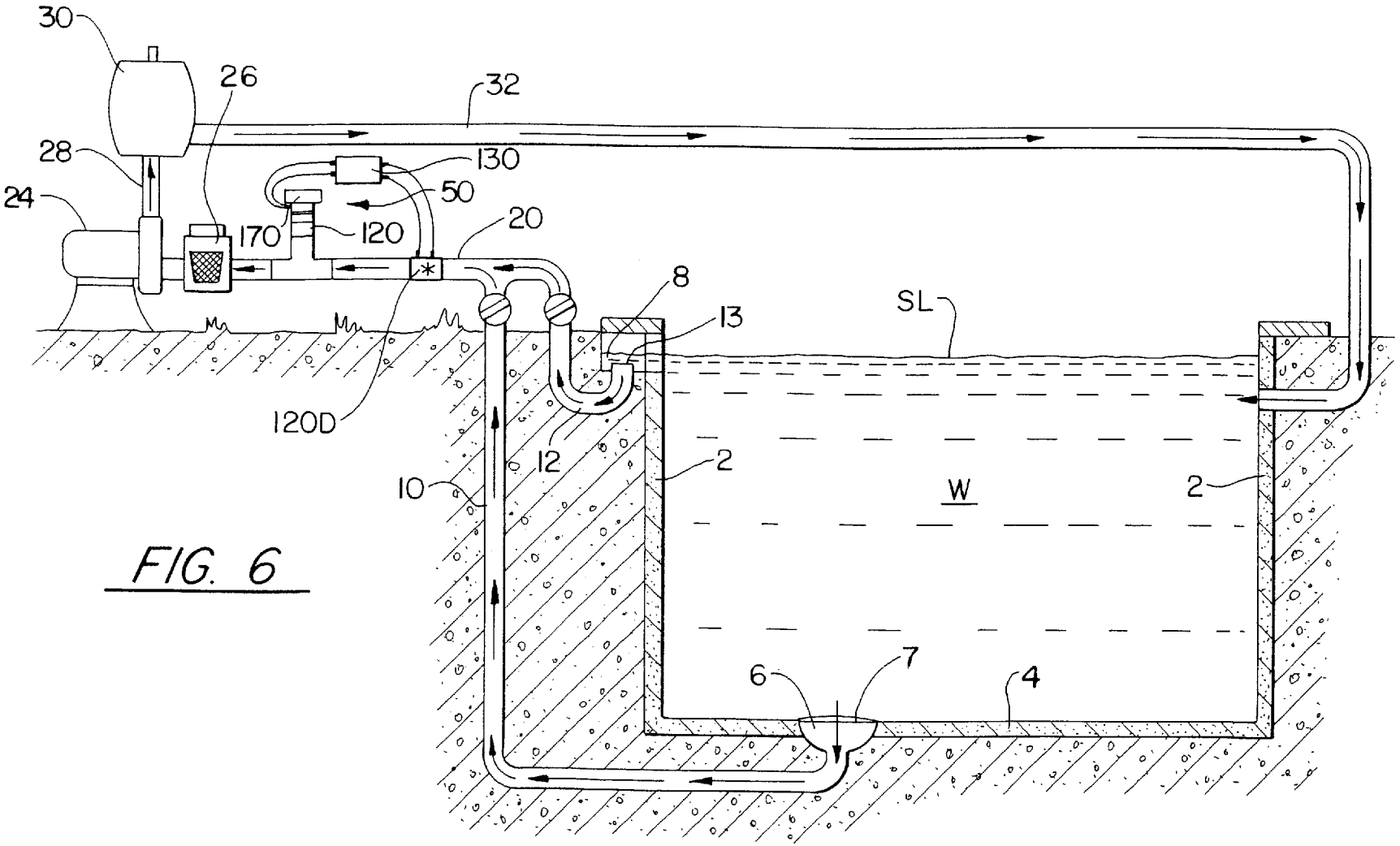
FIG. 6 is an elevational view, in partial section, similar to the views of FIGS. 2, 4 and 5, showing the safety device in yet another embodiment thereof, wherein a fluid flow meter is installed in-line with the intake line, between the intake of the system's pump and the suction intake openings in the swimming pool or other fluid reservoir.

Referring to FIG. 6, the safety device 50 is shown installed in a fluid circulation system of a swimming pool, in yet another embodiment of the invention, wherein a fluid flow meter 120D is installed in-line on the main intake line 20 of the system. The fluid flow meter 120D is another type of sensor contemplated within the spirit and scope of the invention. In this particular embodiment, the analyzer/control 130 is programmed to store a normal operational range of water flow rates of water traveling through the main intake line 20 leading to the intake of the pump 24 when the system is operating normally. Should the water flow rate deviate outside a normal operational range, as sensed by the fluid flow meter 120D, the analyzer/control 130 triggers actuation of the vacuum breaker 170 to introduce air into the intake lines, thereby relieving suction at the open ends 6, 13 within the reservoir W.

Figure 7:
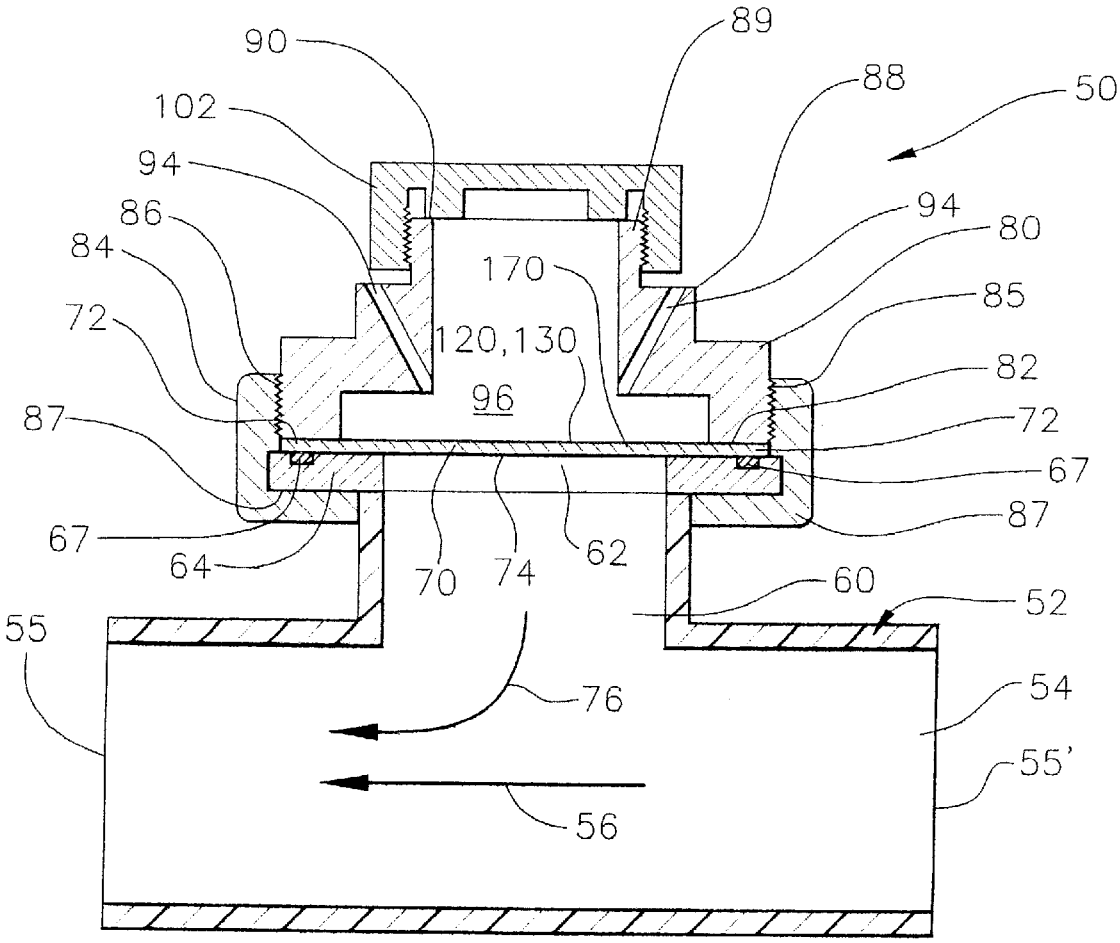
FIG. 7 is a cross-sectional view of yet another embodiment of the safety device of the present invention.
Figure 8:
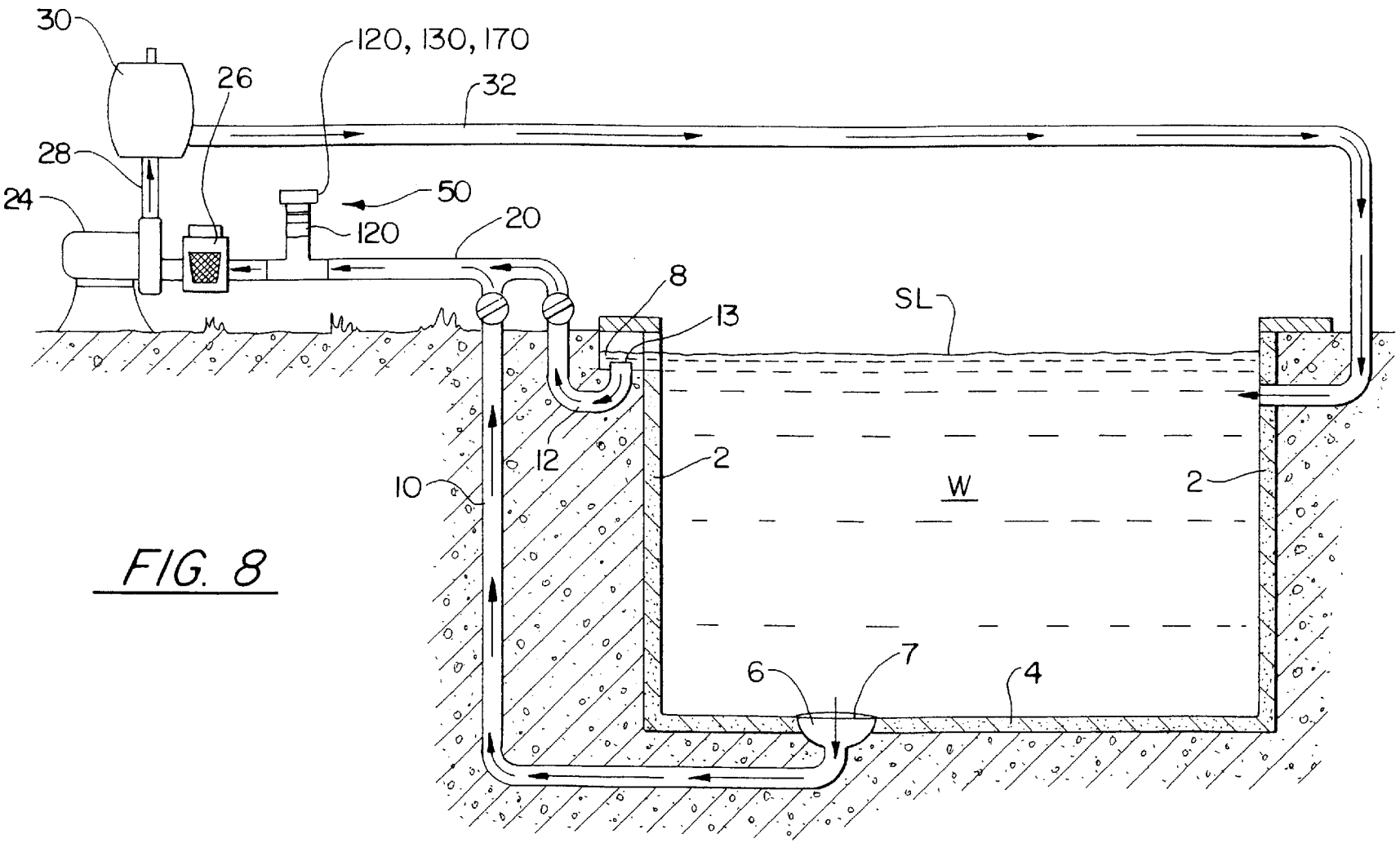
FIG. 8 is an elevational view, in partial section, showing the safety device of the embodiment of FIG. 7 installed in-line on a main suction intake line of a fluid circulation system, between the intake of the system's pump and suction intake openings in the swimming pool or other fluid reservoir.

Referring to FIGS. 7 and 8, yet another embodiment of the safety device 50 is shown, in accordance with a purely mechanical embodiment thereof. Specifically, the safety device 50 in the embodiment of FIGS. 7 and 8 includes a base unit 52 defined primarily by an inverted T-section formed of PVC and having a main through passage 54 defined along the bottom of the inverted T and having opposite open ends 55, 55' which connect in-line to the main intake line 20, as seen in FIG. 8. During normal operating conditions, water flow will travel in a direction of the arrow 56 and through conduit 54 towards the pump 24. The inverted T section of the base unit 52 further includes an upwardly extending vent port 60 extending upwardly from the through passage 54, in fluid communication therewith, to a top end 62. The open top end 62 is surrounded by an annular flange 64 having an O-ring seal 67 fitted to a top face of the flange 64.

A membrane 70 rests on the O-ring 67 in covering relation to the open top 62 of the vent port 60. The membrane 70 may be structured of a frangible material, such as a glass or plastic film which is structured to break in response to a predetermined negative pressure level. Specifically, the thickness of the central zone 74 of the frangible membrane 70 may be determined in accordance with the shattering or disintegrating characteristics of the membrane material. More particularly, the thickness of the central zone 74 of the frangible membrane 70 may be gauged according to the desired predetermined vacuum pressure level at which the frangible membrane is caused to implode and disintegrate.

Alternatively, the membrane 70 may be structured and disposed to move or collapse, such as against a spring force, to introduce air into the through passage 54 and main intake line 20, in response to a vacuum pressure level within the intake line 20 deviating beyond a predetermined maximum level.

Once the membrane 70 is caused to disintegrate, move or otherwise uncover the open top end 62 of the vent port, air from atmosphere is able to quickly enter through the open top to fill the intake lines of the fluid circulation system (as indicated by the arrow 76) thereby eliminating the vacuum in the system and relieving suction at the open intake end within the reservoir W.

The membrane 70 is maintained in place, in covering relation to the open end 62, by a fitting 80 having a lower annular face 82 which opposes the flange 64, sandwiching the rim 72 of the membrane 70 therebetween, as seen in FIG. 7. The O-ring 67 absorbs pressure to prevent the membrane 70 from cracking as the fitting 80 is advanced and tightened towards the flange 64 and against the rim 72 of the membrane 70. A female coupling 84 is provided to facilitate attachment of the fitting 80 to the base unit 52, enabling threaded advancement and withdraw of the fitting 80 relative to the flange 64 and the membrane 70. Threads 85 about the outer periphery of the fitting 80 intermesh with corresponding threads 86 on the inner face of the female coupling 84. An inwardly directed flange 87 on the lower open end of the female coupling 84 engages the under side of the flange 64 of the vent port. The fitting 80 further includes a flat ledge 88 which proceeds inward to a reduced diameter extension 89. The fitting 80 is open at both the opposite ends and has a larger diameter between the annular face 82 compared to a top open end 90. The ledge 88 on the fitting is provided with a plurality of air inlet holes 94 which extend from the top ledge 88 through the thickness of the fitting 80 to provide air flow communication between the exterior atmosphere and an inner chamber 96 above the frangible membrane 70. When the membrane 70 is caused to uncover the open end 62 of the vent port 60, air from atmosphere enters through the inlet holes 94 and through the top opening 62 of the vent port 60 and throughout the suction intake lines of the system to eliminate vacuum therein. A cap 102 is fitted to the reduced diameter extension 89 to cover the open top end 90.

While the instant invention has been shown and described in accordance with preferred embodiments thereof, it is recognized that variations, modifications and changes may be made to the instant disclosure without departing from the spirit and scope of the invention, as set forth in the following claims and within the doctrine of equivalents.

What is claimed is:

1. A device for use in a fluid transfer system having a pump which draws water from a reservoir through one or more intake lines each extending from an open end at the reservoir to an intake of the pump;

said device comprising:

means for sensing one or more operating conditions of the system during operation of the pump;

means for adjustably establishing a normal operational range of said one or more operating conditions;

vacuum pressure relief means for introducing positive pressure into the intake lines of the system to thereby break suction at the open ends of the intake lines upon actuation thereof; and means for actuating said vacuum pressure relief means upon said sensed one or more operating conditions deviating outside of the adjustably established normal operational range.

2. The device as recited in claim 1 wherein said operating conditions include:

negative pressure levels in the system.

3. The device as recited in claim 1 wherein said operating conditions include:

positive pressure levels in the system.

4. The device as recited in claim 1 wherein said operating conditions include:

fluid flow rate in the system.

5. The device as recited in claim 1 wherein said operating conditions include:

the voltage level drawn by the pump.

6. The device as recited in claim 1 wherein said operating conditions include:

the amperage level drawn by the pump.

7. The device as recited in claim 1 further comprising:

means for interrupting operation of the pump upon said sensed one or more operational conditions deviating outside of said adjustably established normal operational range.

8. A method for use in a fluid transfer system having a pump which draws water from a reservoir through one or more intake lines each extending from an open end at the reservoir to an intake of the pump;

said method comprising the steps of:

providing means for adjustably establishing a normal operational range of one or more operating conditions of the system during operation of the pump;

sensing said one or more operating conditions of the system during operation of the pump; and introducing positive pressure into the intake lines of the system to thereby break suction at the open ends of the intake lines upon sensing that the one or more operating conditions have deviated outside of the adjustably established normal operational range.

* * * * *